US010325744B2

(12) United States Patent
Bruan et al.

(10) Patent No.: US 10,325,744 B2
(45) Date of Patent: Jun. 18, 2019

(54) HOLLOW FUSE BODY WITH NOTCHED ENDS

(71) Applicant: LITTELFUSE, INC., Chicago, IL (US)

(72) Inventors: Ped Peterson Bruan, Batangas (PH); Grace Miranda, Lipa (PH); Conrado De Leon, Manila (PH)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 15/169,887

(22) Filed: Jun. 1, 2016

(65) Prior Publication Data

US 2017/0352514 A1 Dec. 7, 2017

(51) Int. Cl.

| | |
|---|---|
| ***H01H 85/143*** | (2006.01) |
| ***H01H 85/157*** | (2006.01) |
| ***H01H 85/175*** | (2006.01) |
| *H01H 85/045* | (2006.01) |

(52) U.S. Cl.

CPC ..... *H01H 85/143* (2013.01); *H01H 85/157* (2013.01); *H01H 85/175* (2013.01); *H01H 85/0458* (2013.01)

(58) Field of Classification Search

CPC ..... H01H 85/143; H01H 85/175
USPC ..... 337/232
See application file for complete search history.

(56) References Cited

U.S. PATENT DOCUMENTS 1,494,141 A * 5/1924 Snow ..... H01H 85/157 337/234
1,861,369 A * 5/1932 Sundt ..... H01H 85/08 337/232
2,222,291 A * 11/1940 Freeman ..... H01H 81/02 337/109
3,094,600 A * 6/1963 Kozacka ..... H01H 85/153 228/224
3,333,336 A * 8/1967 Cameron ..... H01H 69/02 219/609
3,460,086 A * 8/1969 Fister ..... H01H 85/157 29/623
3,644,861 A 2/1972 Fister
3,721,936 A * 3/1973 Belcher ..... H01H 85/303 337/241
3,962,668 A * 6/1976 Knapp, Jr. ..... H01H 85/0418 337/186
3,979,709 A * 9/1976 Healey, Jr. ..... H01H 69/02 337/186
4,101,860 A 7/1978 Fister
(Continued)

FOREIGN PATENT DOCUMENTS

JP 03233825 A 10/1991
JP 8106845 A 4/1996

*Primary Examiner* — Anatoly Vortman

(57) ABSTRACT

Hollow bodies and hollow body fuses are disclosed. Furthermore, methods to provide hollow bodies and hollow body fuses are disclosed. In one implementation, a hollow body includes a center portion and an end portion. An endcap may be coupled to the end portion. A cavity is formed between an inside surface of the endcap and an outer periphery of the end portion. A fusible element may be disposed within the hollow body, the fusible element may be further disposed within the cavity formed between the inside surface of the endcap and the outer periphery of the end portion, the fusible element traveling a substantially diagonal path through a center of the cavity.

20 Claims, 3 Drawing Sheets

(56) References Cited

U.S. PATENT DOCUMENTS 4,122,426 A * 10/1978 Maruo ..... H01H 85/185 337/163
4,158,187 A * 6/1979 Perreault ..... H01H 85/157 337/248
4,159,458 A 6/1979 Wiebe
4,205,294 A * 5/1980 Jacobs, Jr. ..... H01H 85/157 337/234
4,346,362 A * 8/1982 Feenan ..... H01H 85/38 337/159
4,460,887 A * 7/1984 McAlear ..... H01H 85/165 337/186
4,467,308 A * 8/1984 Arikawa ..... H01H 85/157 337/231
4,540,969 A * 9/1985 Sugar ..... H01H 85/0458 337/228
4,646,053 A * 2/1987 Mosesian ..... H01H 85/157 337/232
4,656,453 A * 4/1987 Reeder ..... H01H 69/02 337/236
4,684,915 A * 8/1987 Knapp, Jr. ..... H01H 85/38 337/273
4,703,299 A * 10/1987 Vermij ..... H01H 85/0418 337/158
4,746,784 A * 5/1988 Vermij ..... B23K 1/0056 219/121.64
4,893,107 A * 1/1990 Moner ..... H01H 85/201 174/521
4,918,420 A * 4/1990 Sexton ..... H01H 69/02 337/205
4,920,327 A * 4/1990 Arikawa ..... H01H 85/0411 337/231
5,111,177 A * 5/1992 Krueger ..... H01H 85/30 337/241
5,214,406 A * 5/1993 Reese ..... H01H 85/0411 337/231
5,235,307 A * 8/1993 Oh ..... H01H 85/0411 337/228
5,642,090 A 6/1997 Arikawa
5,926,084 A * 7/1999 Frochte ..... H01H 85/0411 29/623
5,994,994 A * 11/1999 Ito ..... H01H 85/0418 337/228
6,778,061 B2 * 8/2004 Nakano ..... H01H 85/157 337/186
6,798,330 B2 * 9/2004 Arikawa ..... H01H 85/0418 337/187
7,138,899 B2 * 11/2006 Jollenbeck ..... H01H 85/0418 337/250
7,250,843 B2 * 7/2007 Richter ..... H01H 85/157 337/228
7,320,171 B2 * 1/2008 Jollenbeck ..... H01H 85/0418 29/623
8,203,420 B2 6/2012 Wiryana et al.
8,368,502 B2 2/2013 Washizaki et al.
8,937,524 B2 1/2015 de Leon et al.
9,202,656 B2 * 12/2015 Salonga ..... H01H 85/003
9,224,564 B2 * 12/2015 Enriquez ..... H01H 85/0418
9,558,905 B2 * 1/2017 Arce ..... H01H 85/165
9,953,791 B1 4/2018 Bruan et al.
2009/0072943 A1 3/2009 Aberin et al.

* cited by examiner

HOLLOW FUSE BODY WITH NOTCHED ENDS

BACKGROUND

Field

The present invention relates generally to fuses. More specifically, the present invention relates to fuses that include a hollow fuse body.

Description of Related Art

Fuses are used as circuit protection devices and form electrical connections between sources of electrical power and components in circuits that are to be protected. A particular fuse design includes an electrically insulating, hollow fuse body, a fusible element disposed within the hollow fuse body, and electrically conductive endcaps coupled to ends of the hollow fuse body in electrical connection with respective ends of the fusible element. Typically, electrical connections are established between the endcaps and the ends of the fusible element by trapping or crimping the ends of the fusible element between exterior surfaces of the fuse body and interior surfaces of the end caps. A small amount of solder may be disposed within the endcaps prior to fitting the endcaps on the ends of the fuse body for securing the endcaps to the ends of the fuse body and improving the electrical connections with the fusible element.

Due to the tight tolerance between the hollow body and the endcaps and, very little solder flows around the fusible element. Generally, fuse endcaps fit onto the ends of a fuse body in a close clearance relationship therewith, with very little space between the exterior surfaces of the fuse body and the interior surfaces of the end caps. Thus, during assembly of the fuse, there may not be sufficient room between the endcaps and the fuse body to allow solder to reflow and achieve a consistent and reliable connection with the fusible element. It is with respect to these and other considerations that the present improvements may be useful.

SUMMARY

Hollow bodies and hollow body fuses are disclosed. Furthermore, methods to provide hollow bodies and hollow body fuses are disclosed. In one implementation, a hollow body includes a center portion and an end portion. An endcap may be coupled to the end portion. A cavity is formed between an inside surface of the endcap and an outer periphery of the end portion. A fusible element may be disposed within the hollow body, and may further be disposed within the cavity formed between the inside surface of the endcap and the outer periphery of the end portion, the fusible element extending along a substantially diagonal path through a center of the cavity. Solder may fill the cavity and surround the fusible element to create a resilient and durable solder connection to the fusible element.

DETAILED DESCRIPTION

Figure 1:
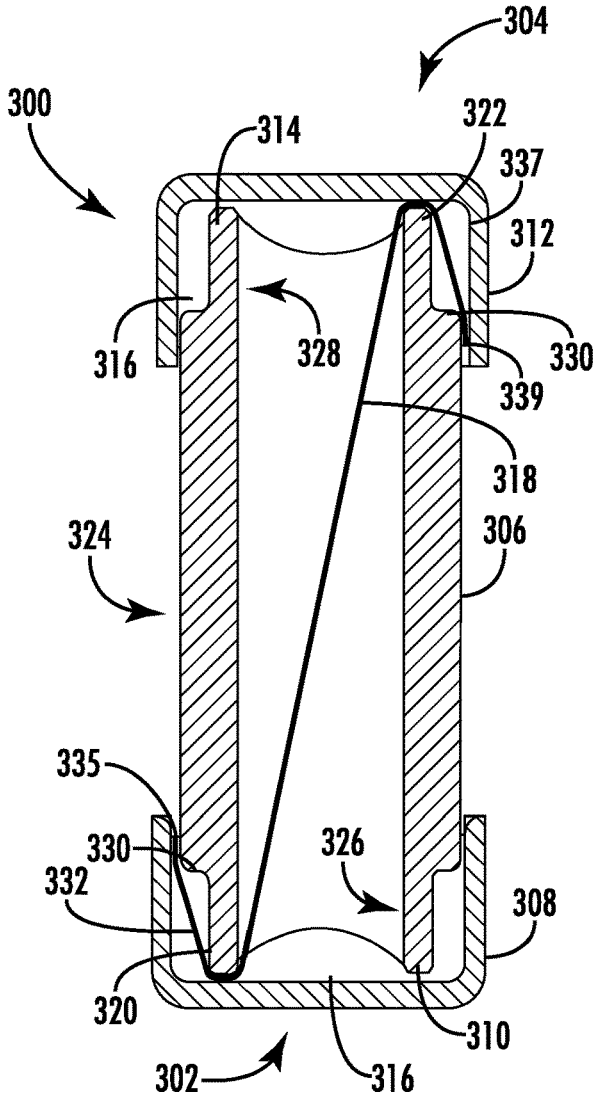
FIG. 1 illustrates a fuse.

FIG. 1 illustrates a cross-sectional view of a fuse 300 in accordance with a non-limiting embodiment of the present disclosure. The fuse 300 may have a generally circular profile in cross-section, as viewed end-on from a bottom 302 or top 304 of the fuse 300. Alternatively, the fuse 300 may have a generally rectangular profile in cross-section, as viewed end-on from the bottom 302 or the top 304 of the fuse 300. The fuse 300 may be implemented as other shape profiles as well. The fuse 300 may have a hollow body 306. The hollow body 306 may be ceramic, plastic, or other suitable electrically non-conducting material. A first endcap 308 may fit over a first end 310 of the hollow body 306 and a second endcap 312 may fit over a second end 314 of the hollow body 306.

Solder 316 may be disposed within each of the endcaps 308 and 312. Furthermore, as will be described in further detail below, the solder 316 may be disposed along a periphery of the hollow body 306. The fuse 300 further includes a fusible element 318, such as wire. The fusible element 318 may be disposed within the hollow body 306. Furthermore, the fusible element 318 may extend along a bottom portion 320 of the first end 310. The fusible element 318 may also extend along a top portion 322 of the second end 314.

The hollow body 306 includes a central portion 324. The central portion 324 has an outer cross-sectional profile of a first size. The hollow body 306 also includes a first end portion 326 that terminates at the first end 310. The first end portion 326 has an outer cross-sectional profile of a second size, where the second size is less than the first size. Therefore, the first end portion 326 is narrower than the central portion 324. In other words, depending on a shape of the hollow body 306, an area, perimeter, diameter, circumference, or the like associated with the first size is greater than an area, perimeter, diameter, circumference, or the like associated with the second size. The hollow body 306 also includes a second end portion 328 that terminates at the second end 314. The second end portion 328 has an outer cross-sectional profile of a second size, where the second size is less than the first size. Therefore, the second end portion 328 is narrower than the central portion 324. In other words, an area, perimeter, diameter, circumference, or the like associated with the first size is greater than the area, perimeter, diameter or circumference associated with the second size.

The central portion 324 of the hollow body 306 integrally couples to the first end portion 326 at a shoulder 330 that extends inwardly to join to the first end portion 326. Similarly, the central portion 324 of the hollow body 306 integrally couples to the second end portion 328 at a shoulder 331 that extends inwardly to join to the second end portion 328.

The fusible element 318 extends through a cavity 332 that is defined between an outer periphery of the first end portion 326 and an inside surface of the first endcap 308. The fusible element 318 extends along a substantially diagonal path through a center of the cavity 332 and terminates at an end 335 that is sandwiched between an inside surface of the first endcap 208 and an outer periphery of the central portion 324. The cavity 332 enables the solder 316 to completely surround at least a portion of the fusible element 318 disposed within the cavity 332.

Similarly, the fusible element 318 is disposed within a cavity 337 that is defined between an outer periphery of the second end portion 328 and an inside surface of the second endcap 312. The fusible element 318 extends along a substantially diagonal path through a center of the cavity 337 and terminates at an end 339 that is sandwiched between an inside surface of the second endcap 312 and an outer periphery of the central portion 324. The cavity 337 enables the solder 316 to completely surround at least a portion of the fusible element 318 disposed within the cavity 337.

In one embodiment, the fusible element 318 does not come into direct contact with an outer periphery of the first end portion 326. That is, the fusible element 318 is offset from the outer periphery of the first and portion 326. Furthermore, in one embodiment, the fusible element 318 does not come into direct contact with an outer periphery of the second end portion 328. That is, the fusible element 318 is offset from an outer periphery of the second and portion 328. Rather, the solder 316 is disposed between the fusible element 318 and an outer periphery of the first end portion 326, and the 316 is disposed between the fusible element 318 and an outer periphery of the second end portion 328.

Figure 2:
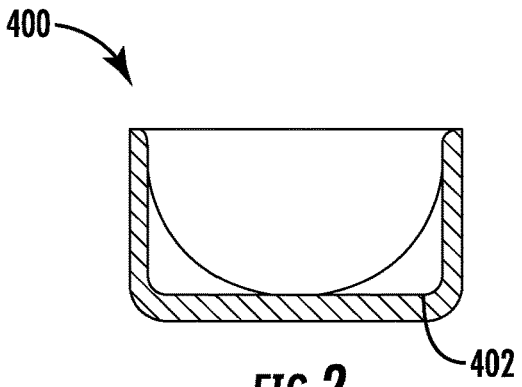
FIG. 2 illustrates an exemplary fuse endcap with solder disposed therein.

FIG. 2 illustrates and exemplary endcap 400 with solder 402 disposed therein. The endcap 400 may be substantially similar to the first and second endcaps 308 and 312 described above. In a process or method of manufacturing the fuse 300, the endcap 400 may be at least partially fitted over the first end 310 of the hollow body 306. Furthermore, another endcap 400 may be at least partially fitted over the second end 314 of the hollow body 306. The fusible element 318 may be arranged within the interior and further arranged on the exterior of the hollow body 306, as illustrated in FIG. 1, prior to the fitting of one or more of the endcaps 400. The process of fitting the endcaps 400 over the hollow body 306 may include heating the endcaps 400 to melt the solder 402. The process of melting the solder enables the solder to flow at least into the cavities 332.

Figure 3:
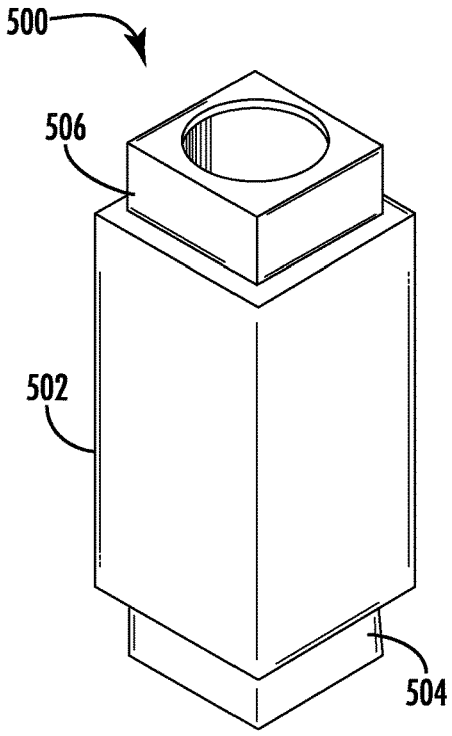
FIGS. 3-8 illustrate exemplary hollow body implementations.

FIG. 3 illustrates an exemplary embodiment of a hollow body 500. The hollow body 500 may be implemented as part of a fuse, such as the fuse 300 described above. The hollow body 500 has an outer square cross-sectional profile. The hollow body 500 may include a central portion 502. The central portion 502 has an outer square cross-sectional profile. The central portion 502 has an outer cross-sectional profile of a first size. The hollow body 500 also includes a first end portion 504. The first end portion 504 has an outer cross-sectional profile of a second size, where the second size is less than the first size. In other words, an area or perimeter associated with the first size is greater than an area or perimeter associated with the second size. The hollow body 500 also includes a second end portion 506. The second end portion 506 has an outer cross-sectional profile of a second size, where the second size is less than the first size. In other words, an area or perimeter associated with the first size is greater than an area or perimeter associated with the second size.

Figure 4:
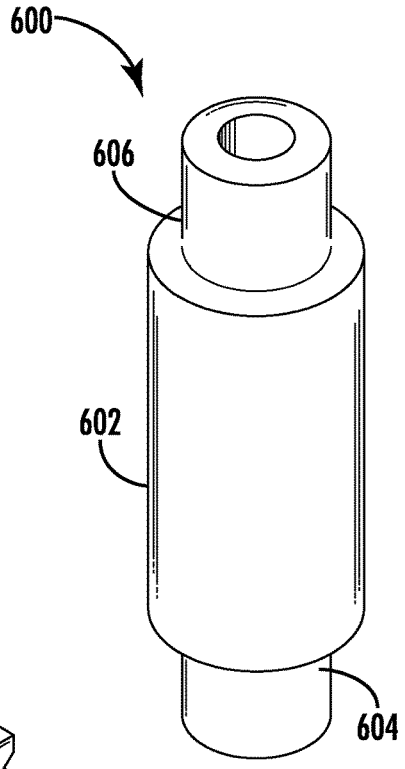

FIG. 4 illustrates an exemplary embodiment of a hollow body 600. The hollow body 600 may be implemented as part of a fuse, such as the fuse 300 described above. The hollow body 600 has an outer circular cross-sectional profile. The hollow body 600 may include a central portion 602. The central portion 602 has an outer circular cross-sectional profile. The central portion 602 has an outer cross-sectional profile of a first size. The hollow body 600 also includes a first end portion 604. The first end portion 604 has an outer cross-sectional profile of a second size, where the second size is less than the first size. In other words, a circumference or diameter associated with the first size is greater than a circumference or diameter associated with the second size. The hollow body 600 also includes a second end portion 606. The second end portion 606 has an outer cross-sectional profile of a second size, where the second size is less than the first size. In other words, a circumference or diameter associated with the first size is greater than a circumference or diameter associated with the second size.

Figure 5:
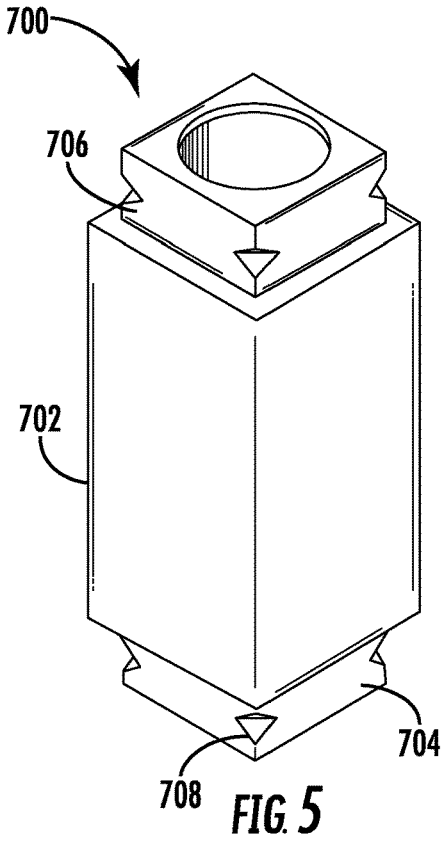

FIG. 5 illustrates an exemplary embodiment of a hollow body 700. The hollow body 700 may be implemented as part of a fuse, such as the fuse 300 described above. The hollow body 700 has an outer square cross-sectional profile. The hollow body 700 may include a central portion 702. The central portion 702 has an outer square cross-sectional profile. The central portion 702 has an outer cross-sectional profile of a first size. The hollow body 700 also includes a first end portion 704. The first end portion 704 has an outer cross-sectional profile of a second size, where the second size is less than the first size. In other words, an area or perimeter associated with the first size is greater than an area or perimeter associated with the second size. The hollow body 700 also includes a second end portion 706. The second end portion 706 has an outer cross-sectional profile of a second size, where the second size is less than the first size. In other words, an area or perimeter associated with the first size is greater than an area or perimeter associated with the second size.

The hollow body 700 illustrated in FIG. 5 may include one or more notches 708. The one or more notches 708 may be entirely or partially filled with solder when an endcap (e.g., endcap 400) is pressed onto an end portion (e.g., first end portion 704) of the hollow body 700. Heat may be applied to the endcap to enable the solder to flow. Thus, the one or more notches 708 may aid in the retention of an endcap pressed onto an end portion of the hollow body 700. More particularly, hardened solder in the one or more notches 708 may couple or be integral with hardened solder within the cavity 332. Therefore, the hardened solder in the one more notches 708 serves as an anchor for the endcap pressed onto an end portion of the hollow body 700.

Figure 6:
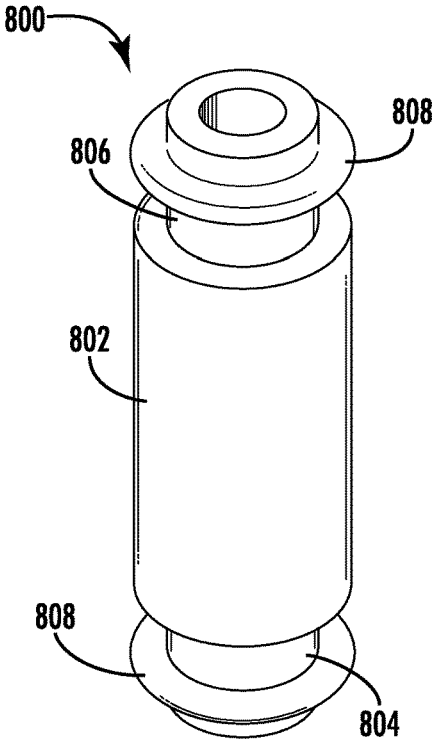

FIG. 6 illustrates an exemplary embodiment of a hollow body 800. The hollow body 800 may be implemented as part of a fuse, such as the fuse 300 described above. The hollow body 800 has an outer circular cross-sectional profile. The hollow body 800 may include a central portion 802. The central portion 802 has an outer circular cross-sectional profile. The central portion 802 has an outer cross-sectional profile of a first size. The hollow body 800 also includes a first end portion 804. The first end portion 804 has an outer cross-sectional profile of a second size, where the second size is less than the first size. In other words, a circumference or diameter associated with the first size is greater than a circumference or diameter associated with the second size. The hollow body 800 also includes a second end portion 806. The second end portion 806 has an outer cross-sectional profile of a second size, where the second size is less than the first size. In other words, a circumference or diameter associated with the first size is greater than a circumference or diameter associated with the second size.

The hollow body 800 illustrated in FIG. 6 may include one or more anchor ledges 808. The one or more anchor ledges 808 may be entirely or partially surrounded with solder when an endcap (e.g., endcap 400) is pressed onto an end portion (e.g., first end portion 804) of the hollow body 800. Heat may be applied to the endcap to enable the solder to flow around the one or more anchor ledges 808 and rigidly encapsulate the one or more anchor ledges 808 when the solder hardens. Thus, the one or more anchor ledges 808 may aid in the retention of an endcap pressed onto an end portion of the hollow body 800.

Figure 7:
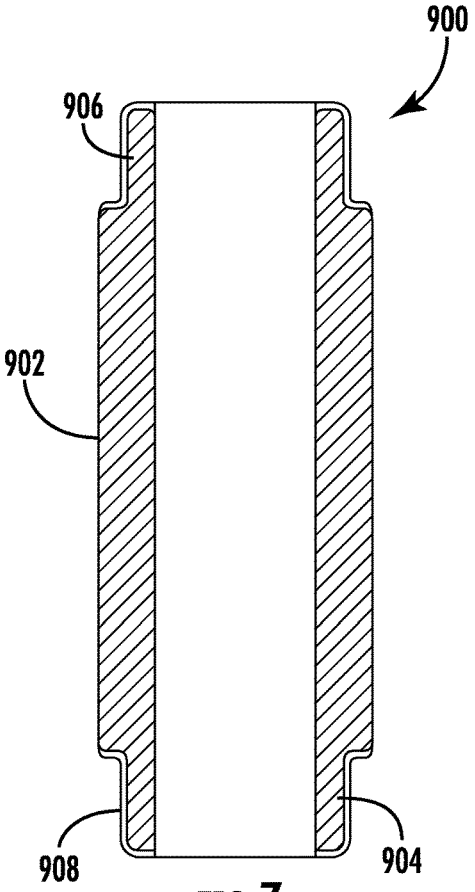

FIG. 7 illustrates an exemplary embodiment of a hollow body 900 in cross-section. The hollow body 900 may be implemented as part of a fuse, such as the fuse 300 described above. The hollow body 900 may include a central portion 902. The central portion 902 has an outer cross-sectional profile. The central portion 902 has an outer cross-sectional profile of a first size. The hollow body 900 also includes a first end portion 904. The first end portion 904 has an outer cross-sectional profile of a second size, where the second size is less than the first size. In other words, an area, circumference or diameter associated with the first size is greater than an area, circumference or diameter associated with the second size. The hollow body 900 also includes a second end portion 906. The second end portion 906 has an outer cross-sectional profile of a second size, where the second size is less than the first size. In other words, an area, circumference or diameter associated with the first size is greater than an area, circumference or diameter associated with the second size.

The hollow body 900 may include a layer of metallization 908 on each of the first end portion 904 and second end portion 906. Solder (not shown) may come in contact with the layer of metallization 908 when an endcap (e.g., endcap 400) is pressed onto an end portion (e.g., first end portion 904) of the hollow body 900. Thus, since the layer of metallization 908 is in contact with the solder and with portions of the fusible element 910 (as shown in FIG. 7), the layer of metallization 908 may facilitate robust electrical conductivity between the solder, the fusible element 910, and an endcap (e.g., endcap 400) that is pressed onto an end portion (e.g., first end portion 904) of the hollow body 900.

Figure 8:
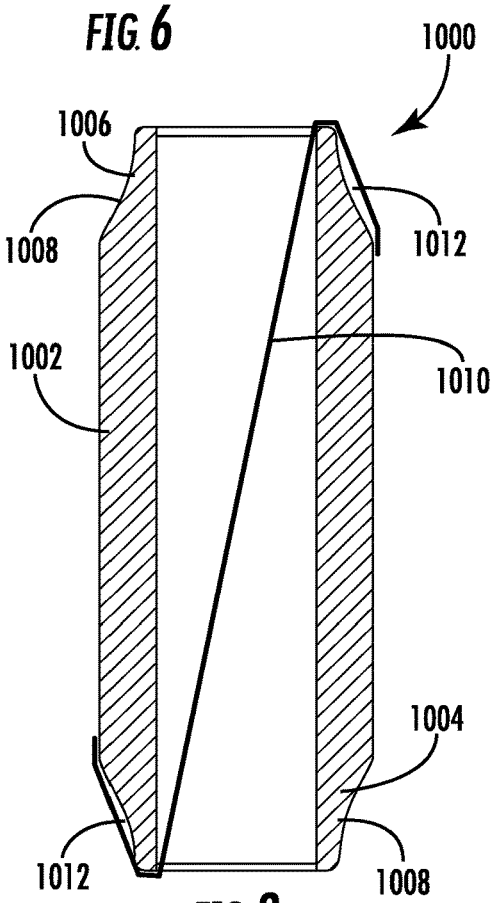

FIG. 8 illustrates an exemplary embodiment of a hollow body 1000. The hollow body 1000 may be implemented as part of a fuse, such as the fuse 300. The hollow body 1000 has an outer circular cross-sectional profile. The hollow body 1000 may include a central portion 1002. The central portion 1002 has an outer circular cross-sectional profile. The central portion 1002 has an outer cross-sectional profile of a first size. The hollow body 1000 also includes a first end portion 1004. The first end portion 1004 has an outer cross-sectional profile of a second size, where the second size is less than the first size. In other words, a circumference or diameter associated with the first size is greater than an area or diameter associated with the second size. The hollow body 1000 also includes a second end portion 1006. The second end portion 1006 has an outer cross-sectional profile of a second size, where the second size is less than the first size. In other words, a circumference or diameter associated with the first size is greater than an area or diameter associated with the second size.

Each of the first end portion 1004 and second end portion 1006 may have a generally concave or curved shape 1008. In one implementation, the generally concave or curved shape 1008 of each of the first and portion 1004 and the second and portion 1006 allows for the elimination of the shoulders 330 described above with regard to the fuse 300 (see FIG. 1). An exemplary fusible element 1010 is illustrated in FIG. 8 to show that a cavity 1012 is at least formed between each of the portions 1004 and 1006 and the fusible element 1010. Therefore, solder may and occupy the cavities 1012 and completely surround adjacent portions of the fusible element 1010 upon coupling endcaps to the hollow body 1000.

While hollow body fuses and a method for manufacturing structurally hollow body fuses have been described with reference to certain embodiments, it will be understood by those skilled in the art that various changes may be made and equivalents may be substituted without departing from the spirit and scope of the claims of the application. Other modifications may be made to adapt a particular situation or material to the teachings disclosed above without departing from the scope of the claims. Therefore, the claims should not be construed as being limited to any one of the particular embodiments disclosed, but to any embodiments that fall within the scope of the claims.

We claim:

1. A fuse, comprising:

a hollow body including a center portion and a first end portion, the first end portion narrower than the center portion;

a first endcap coupled to the first end portion, a cavity formed between an inside surface of the first endcap and an outer periphery of the first end portion, the outer periphery of the first end portion comprising:

a shoulder surface extending perpendicularly from an outer surface of the center portion of the hollow body;

an end portion outer surface extending perpendicularly from the shoulder surface, the end portion outer surface extending parallel to the outer surface of the center portion of the hollow body; and an endmost surface extending perpendicularly from the end portion outer surface;

a fusible element disposed within the hollow body, the fusible element further disposed within the cavity formed between the inside surface of the first endcap and the outer periphery of the first end portion, wherein the fusible element extends diagonally between the outer surface of the center portion of the hollow body and the endmost surface of the first end portion so the fusible element is not in direct contact with the shoulder surface or the end portion outer surface of the first end portion; and solder disposed in the cavity, the solder surrounding the fusible element disposed within the cavity with the solder disposed between the fusible element and the inside surface of the first endcap and between the fusible element and the end portion outer surface of the outer periphery of the first end portion such that the solder is sandwiched between the fusible element and the end portion outer surface of the outer periphery of the first end portion.

2. The fuse according to claim 1, wherein the fusible element extends along a substantially diagonal path through a center of the cavity.

3. The fuse according to claim 1, wherein the fusible element is sandwiched between a portion of the inside surface of the first endcap and a portion of an outer periphery of the center portion.

4. The fuse according to claim 1, wherein the fusible element is offset from the outer periphery of the first end portion.

5. The fuse according to claim 4, wherein the fusible element is offset from the inside surface of the first endcap.

6. The fuse according to claim 1, wherein the fusible element is offset from the outer periphery of the first end portion and further offset from the inside surface of the first endcap.

7. The fuse according to claim 1, wherein the hollow body includes a second end portion, the second end portion narrower than the center portion, and further comprising a second endcap coupled to the second end portion, another cavity formed between an inside surface of the second endcap and an outer periphery of the second end portion.

8. The fuse according to claim 7, wherein the fusible element extends along a substantially diagonal path through a center of the another cavity.

9. The fuse according to claim 8, further comprising solder disposed in the another cavity, the solder surrounding the fusible element disposed within the another cavity.

10. The fuse according to claim 7, wherein the fusible element is offset from the outer periphery of the second end portion.

11. The fuse according to claim 7, wherein the fusible element is offset from the inside surface of the second endcap.

12. The fuse according to claim 1, further comprising metal disposed on the first end portion.

13. The fuse according to claim 1, further comprising at least one notch formed on the first end portion.

14. The fuse according to claim 1, further comprising a ledge formed on the first end portion.

15. A fuse, comprising:

a hollow body including a center portion and a first end portion;

a first endcap coupled to the first end portion, a cavity formed between an inside surface of the first endcap and an outer periphery of the first end portion, the outer periphery of the first end portion comprising:

a shoulder surface extending perpendicularly from an outer surface of the center portion of the hollow body;

an end portion outer surface extending perpendicularly from the shoulder surface, the end portion outer surface extending parallel to the outer surface of the center portion of the hollow body; and an endmost surface extending perpendicularly from the end portion outer surface;

a fusible element disposed within the hollow body, the fusible element further disposed within the cavity formed between the inside surface of the first endcap and the outer periphery of the first end portion, the fusible element extending along a substantially diagonal path through a center of the cavity, wherein the fusible element extends diagonally between the outer surface of the center portion of the hollow body and the endmost surface of the first end portion so the fusible element is not in direct contact with the shoulder surface or the end portion outer surface of the first end portion; and solder disposed in the cavity between the fusible element and the inside surface of the first endcap and between the fusible element and the end portion outer surface of the outer periphery of the first end portion such that the solder is sandwiched between the fusible element and the end portion outer surface of the outer periphery of the first end portion.

16. The fuse according to claim 15, further comprising a second endcap coupled to a second end portion of the hollow body, and another cavity formed between an inside surface of the second endcap and an outer periphery of the second end portion.

17. The fuse according to claim 16, wherein the fusible element is further disposed within the another cavity, the fusible element traveling substantially diagonal path through a center of the another cavity.

18. The fuse according to claim 17, further comprising solder disposed within the another cavity.

19. The fuse according to claim 15, further comprising at least one notch formed on the first end portion.

20. The fuse according to claim 15, further comprising a ledge formed on the first end portion.

* * * * *